US007469496B1

(12) United States Patent
Kellgren

(10) Patent No.: US 7,469,496 B1
(45) Date of Patent: Dec. 30, 2008

(54) DUAL PIVOTING EXTRACTORS

(75) Inventor: George L. Kellgren, Cocoa, FL (US)

(73) Assignee: Kel-Tec CNC Industries, Inc., Cocoa, FL (US)

( * ) Notice: Subject to any disclaimer, the term of this patent is extended or adjusted under 35 U.S.C. 154(b) by 221 days.

(21) Appl. No.: 11/523,339

(22) Filed: Sep. 19, 2006

(51) Int. Cl.
*F41A 15/10* (2006.01)
*F41A 15/00* (2006.01)

(52) U.S. Cl. ..... 42/46

(58) Field of Classification Search ..... 42/25, 42/46, 47, 68

See application file for complete search history.

(56) References Cited

U.S. PATENT DOCUMENTS

| | | | | | |
|---|---|---|---|---|---|
| 2,465,553 | A | * | 3/1949 | Robinson, Jr. | 42/25 |
| 2,476,904 | A | | 7/1949 | Perry | 42/35 |
| 2,603,019 | A | * | 7/1952 | Elkas | 42/25 |
| 2,603,020 | A | * | 7/1952 | Hussey | 42/25 |
| 2,803,908 | A | * | 8/1957 | Raley | 42/22 |
| 2,866,289 | A | | 12/1958 | Wilcox | 42/87 |
| 3,000,126 | A | | 9/1961 | Robinson | 42/18 |
| 3,087,387 | A | | 4/1963 | Browning | 89/33 |
| 3,270,617 | A | | 9/1966 | Seymour et al. | 89/33 |
| 3,733,728 | A | | 5/1973 | Kuslich | 42/1 R |
| 4,265,042 | A | | 5/1981 | Isola | 42/1 T |
| 4,553,469 | A | * | 11/1985 | Atchisson | 89/191.02 |
| 4,920,678 | A | * | 5/1990 | Brown | 42/25 |
| 5,024,016 | A | | 6/1991 | Smith | 42/25 |
| 5,046,275 | A | * | 9/1991 | Brown | 42/25 |
| 5,307,724 | A | | 5/1994 | Breuer et al. | 89/24 |
| 5,675,924 | A | | 10/1997 | Predazzer | 42/25 |
| 5,934,002 | A | | 8/1999 | Blanchet | 42/98 |
| 6,389,725 | B1 | | 5/2002 | Denuit | 42/25 |
| 2005/0235543 | A1 | | 10/2005 | Murello | 42/47 |

OTHER PUBLICATIONS

H211, Feb. 3, 1987, Vanderbeck.

* cited by examiner

*Primary Examiner*—Bret Hayes
(74) *Attorney, Agent, or Firm*—Brian S. Steinberger; Law Offices of Brian S. Steinberger, P.A.

(57) ABSTRACT

Apparatus and methods to improve the functioning of a firearm includes a simplistic, condensed extractor mechanism that is easy to manufacture. Two symmetrical extractors mounted on the sides of a sliding breech block rotate around a pivot point and navigate forward to connect to the rim of a cartridge in the barrel of a firearm. Spring arrangements force the extractors upward and forward in an extraction/ejection cycle that begins with the extractor arms grabbing the rear end of a cartridge, moving rearward with the cartridge or spent case on a horizontal plane relative to the rifle barrel. The extracted case is rotated upward at an angle, then moved forward and fed into an ejection chute just above the barrel. Concurrently, another round is fed into the chamber of the barrel and the extractor arms cam down thereby engaging the rim of a new cartridge; thus completing the cycle.

18 Claims, 15 Drawing Sheets

OPERATING CYCLE OF CARTRIDGE CASE EXTRACTOR ASSEMBLY

1. Extractor Assembly in Forward Most Position with Lower Catch Area of Dual Pivoting Extractor Arms Gripping Rear End of Cartridge in Barrel of Firearm

↓

2. Weapon Fires Leaving Empty Cartridge Case in Barrel of Firearm

↓

3. Force One Moves Extractor Assembly Rearward on Sliding Breech Block as Dual Pivoting Extractor Arms Pull the Empty Case out of Chamber

↓

4. Dual Pivoting Extractor Arms Raise Empty Case at an Acute Angle Relative to the Barrel of Firearm and NEW Cartridge is Exposed in Magazine

↓

5. Force Two Moves Extractor Assembly Forward while Dual Pivoting Extractor Arms Hold Empty Case in Angled Position with Front end of Case in Alignment with Ejection Chute on Top of Barrel of Firearm; Sliding Breech Block Moves NEW Cartridge from Magazine into Barrel of Firearm

↓

6. Empty Cartridge Case Contacts Entrance to Ejection Chute and Case Moves Upward From the Lower Catch Area to the Upper Catch Area of the Dual Pivoting Extractor Arms

↓

7. Force Three Moves Empty Cartridge Case from Upper Catch Area of Dual Pivoting Extractor Arms into a Horizontal Position Created by the Bolt Carrier Extension and the Ejector Chute; as Upper Catch Area Releases Empty Cartridge, a NEW Cartridge is chambered into Barrel of Firearm by Sliding Breech Block

↓

8. Force Four Pushes Empty Cartridge Case down the Ejection Chute as Dual Pivoting Extractor Arms Cam Down to grip the rear end of NEW cartridge

↓

9. Empty Cartridge Case Safely Exits Ejection Chute Curved to Side of Firearm

10. Return to 1.

Fig. 15

DUAL PIVOTING EXTRACTORS

The present invention generally relates to extractors for handheld firearms, and more particularly, to apparatus, devices, systems and methods for extracting and ejecting cartridges and spent cartridge cases.

BACKGROUND AND PRIOR ART

There has been considerable prior art for cartridge ejection mechanisms, and the prior art dates back to mid-20$^{th}$ century times, with cartridge or spent cartridge case ejection mechanism of various structures and configurations. In the discussion below, the terms "cartridge case", "spent cartridge case" and "case", are used interchangeably, to mean the metal casing or holder, usually cylindrical in shape, that is loaded with a primer, powder charge, and bullet.

Cartridge cases drop at random to the ground or surface beneath or beside the firearm and in the course of ejection are liable to soil the clothing of the user or of onlookers nearby since they become fouled by reason of the explosive gases emitted upon firing. The random ejection of spent cartridge cases can be very disturbing or even injurious to someone standing close to the shooter when the gun is fired as the case is expelled from the gun with considerable violence.

When a shooter is standing close to a wall for protection of his or her body while operating a firearm, the shooter can be injured or burned when the spent cartridge case is randomly ejected from the firearm and ricochets from the nearby wall used as a shield.

The ejection and spill of empty cartridge cases on to the floor of aircraft and ships can create hazards, for example, the empty cases could become ingested into the aircraft engine or trigger slip and fall injuries to persons moving over the floor in the heat of battle. The spent cases also have some value as scrap material and it is economical to collect as many as possible for subsequent reuse and/or sale.

The known prior art includes several patents discussed below. U.S. Pat. No. 2,476,904 to C. A. Perry, has a breech block with an extractor that engages the cartridge case, extracts the empty cartridge, then exposes the cartridge through an ejection aperture below the barrel of a firearm. U.S. Pat. No. 2,866,289 to L. L. Wilcox describes an unloading attachment for rifles wherein an unloading tube acts as a guide way for cartridges. U.S. Pat. No. 3,000,126 to R. S. Robinson describes a cartridge guiding mechanism that guides the cartridge through an exit groove.

U.S. Pat. No. 3,087,387 to V. A. Browning describes a case catcher for firearms that moves rearward after firing wherein, the spent case is extracted from the firing chamber and drawn laterally before being ejected via an opening. U.S. Pat. No. 3,270,617 to R. V. Seymour et al. describes a case catcher attached to the reciprocal bolt of a firearm and is readily attached to existing firearms.

U.S. Pat. No. 3,733,728 to Kuslich describes a case catcher with parallel arms for repeating firearms. U.S. Pat. No. 4,265,042 Isola describes a cartridge retriever mounting and attaching device for a Colt M-16 rifle that is fitted on top of rifle with lugs. U.S. Statutory Invention Registration H211 to Vanderbeck discloses an extractor hook-feed ramp combination wherein the spent cartridge case spins around a pivot formed by the extraction hook.

U.S. Pat. No. 5,024,016 to D. E. Smith describes a self-loading pistol with an insertable mechanism for extracting empty cartridge cases. U.S. Pat. No. 5,307,724 to Breuer et al. describes dual claws fastened to the ends of L-shaped ejection levers used to remove empty cartridge cases from large caliber guns. U.S. Pat. No. 5,675,924 to Predazzer describes an ejection device for a firearm having an automatic or manual cycle using an extractor that catches the casing by its neck with an ejection lever mounted in a swiveling manner around an axis.

U.S. Pat. No. 5,934,002 to Blanchet describes a claw type device with a detachable container for receiving and collecting spent cases ejected from a firearm having a spent case ejection port. U.S. Patent Publication 2005/0235543 A1 to J. Murello describes a cartridge ejection mechanism with guide rods and pivoting extractors in a bolt head attached to the breech block of a firearm. U.S. Pat. No. 6,389,725 to Denuit provides an improvement to the Predazzer '924 patent supra to make sure the extractor exposes the casing when it is tilted.

These patents disclose the respective art in relation to ejecting cartridge cases from firearms, but do not disclose an easy to manufacture, spring-loaded, dual pivoting extractor with ejection chute on top of a firearm that safely extracts an empty cartridge case and does not interfere with the shooter's sight line.

SUMMARY OF THE INVENTION

The disclosed invention, which shall be subsequently described in greater detail, provides a new device designed to improve the functioning of a bull pup rifle with a forward cartridge case ejecting system. The design and precision with which the dual pivoting extractors of the present invention are made contribute to many advantages over the prior art. The new and novel features include, but are not limited to, the efficient arrangement of a spring-loaded bolt carrier attached to a breech block having dual pivoting extractor arms that extract, pivot and release a cartridge or an empty cartridge case into an ejection chute. The design and function of the apparatus of the present invention has not been suggested, anticipated or even rendered obvious by any of the prior art references.

The first objective of the present invention is to provide a cartridge remover and methods that pull a cartridge or an empty case from a firearm and directs it to an ejector chute.

The second objective of the present invention is to provide a dual pivoting extractor and methods that pull a cartridge or an empty case from a firearm, raise or pivot the case upward while carrying the cartridge or spent case safely to an exit point on top of the firearm.

The third objective of the present invention is to provide a permanently attached device or system to the breech block of a firearm that extracts and ejects a cartridge or cartridge case in a safe manner without interfering with the shooter's line of sight.

The fourth objective of the present invention is to provide a permanently attached device or system to the breech block of a firearm that extracts and ejects a cartridge or cartridge case in a safe manner without injury to the shooter or persons in close range to the shooter.

The fifth objective of the present invention is to provide a permanently attached device or system to the breech block of a firearm that extracts and ejects a cartridge or cartridge case in a safe manner when the firearm is being operated in close quarters, such as, against a wall or behind a shield.

The sixth objective of the present invention is to provide a dual pivoting extractor or method that disposes of a cartridge or empty cartridge case to the side of the firearm.

A preferred apparatus for ejecting cartridges or spent cartridge cases from firearms, includes a rifle having a trigger and a magazine holding ammunition, an extractor with a pivoting arm having one end that grips a rear end of a cartridge case, the pivoting extractor arm raising and lowering a spent cartridge case relative to the rifle, and an ejector for ejecting the spent cartridge case into an exit from the firearm.

The preferred extractor apparatus of the present invention has a pair of pivoting arms with ends that grip about the rear end of a spent cartridge case. The ends that grip about the rear end of the spent cartridge case have a lower catch area that grips the spent cartridge case when the pivoting arm is moving in a rearward position and the ejector, which includes an upper catch area that releases the spent cartridge case as the pivoting arm cams down from a pivoted position into an exit portal. The preferred extractor further includes an ejector impact surface that pushes the released cartridge down or through the exit portal.

The preferred exit portal includes a chute on the rifle that allows the spent cartridge case to eject forward and to one side of the rifle or another preferred exit portal includes an attached flexible, fireproof container to receive and collect the spent cartridge case ejected forward and to one side of the rifle.

A more preferred extractor of the present invention includes a slideable carriage for supporting the pivoting arm, wherein the slideable cartridge moves the grabbed spent cartridge case in a horizontal direction relative to the rifle. The pivoting extractor arms cam up the spent cartridge case to an acute angle in line with the exit portal on the firearm. The preferred pivoting extractor arms release the spent cartridge case into an ejection chute and cam down to grip about the rear end of a new cartridge.

The more preferred extractor apparatus of the present invention further includes a spring-loaded bolt carrier extension, which is activated manually by a handle or activated automatically by a gas piston.

A preferred method for extracting and ejecting a cartridge or a spent cartridge case from a firearm includes providing a rifle having a trigger and a magazine holding ammunition, attaching an extractor with a pivoting extractor arm having one end that grips a rear end of a cartridge case, the pivoting arm raising and lowering a spent cartridge case relative to the rifle, releasing the spent cartridge case into an exit portal on the firearm, and pushing the released spent cartridge case into the exit portal thereby safely removing the spent cartridge case on the side of the firearm and out of the sight line.

The preferred extractor/ejection method includes a pair of pivoting arms, the pivoting arms having ends that grip about the rear end of the spent cartridge case. The ends that grip about the rear end of the spent cartridge case have a lower catch area that grips and extracts the spent cartridge case when the pivoting arm is moving in a rearward position and ejects the spent cartridge case when an upper catch area of the pivoting arm releases the spent cartridge case as the pivoting arm cams down from a pivoted position into an exit portal. The ejector further includes an ejector impact surface that pushes the case down and through the exit portal.

The preferred method has an exit portal that includes a chute on the rifle that receives and allows the spent cartridge case to eject forward and to one side of the rifle. Another preferred exit portal includes an attached flexible, fireproof container to receive and collect the spent cartridge case ejected forward and to one side of the rifle.

The preferred method of extracting and ejecting cartridges or cartridge cases further includes a slideable carriage for supporting the pivoting arm, wherein the slideable carriage moves the grabbed spent cartridge case in a horizontal direction relative to the rifle.

The preferred method also includes pivoting extractor arms that cam up the spent cartridge case to an acute angle in line with the exit portal on the firearm. The pivoting extractor arms release the spent cartridge case into an ejection chute and cam down to grip about the rear end of a new cartridge.

The preferred method further includes a spring-loaded bolt carrier extension that is manually activated by a handle or automatically activated by a gas piston.

Further objects and advantages of this invention will be apparent from the following detailed description of a presently preferred embodiment, which is illustrated in the accompanying flow chart and drawings.

BRIEF DESCRIPTION OF THE FIGURES

Referring particularly to the drawings for the purposes of illustration only, and not limitation:

FIG. 15 is a flow chart of the extraction and ejection cycle of a cartridge case extractor assembly of the present invention.

DESCRIPTION OF THE PREFERRED EMBODIMENT

Figure 1:
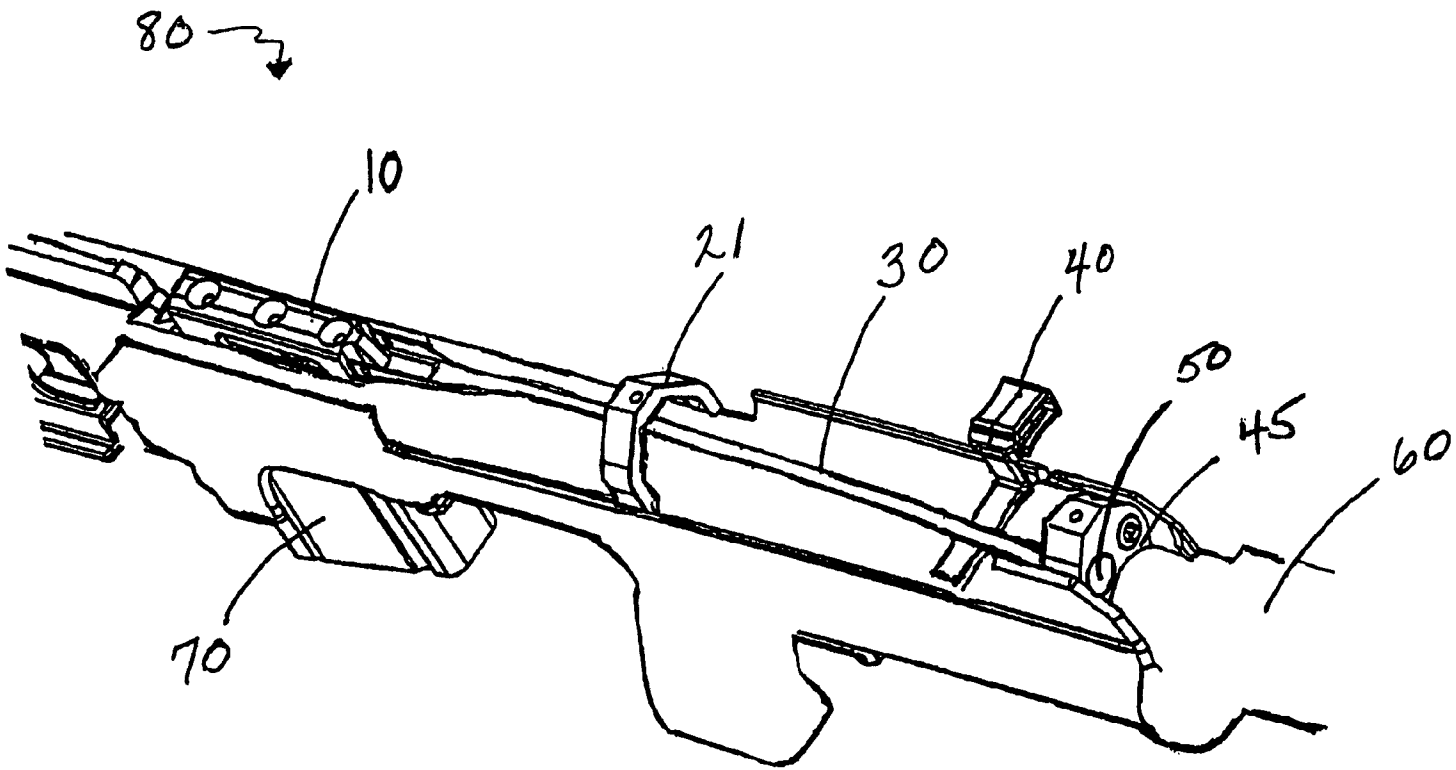
FIG. 1 is a plan perspective view of the cartridge or cartridge case extractor assembly of the present invention.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

It would be useful to discuss the meanings of some words used herein and their applications before discussing the cartridge or spent cartridge case extractor of the present invention and method of using the same. A cartridge that has not been fired can be extracted and ejected using the present invention and it is understood to be within the scope of the invention.

"Ammunition" and "cartridge" are used interchangeably to mean a cylindrical, usually metal casing containing the primer and powder charge or bullet for a firearm.

"Cartridge remover," "cartridge case extractor," "extractor arms" and "extractor" are used interchangeably to mean a device for withdrawing a cartridge or spent cartridge case from the chamber of the barrel of a firearm. The device holds onto the rim of the ammunition, extracts and ejects the empty casing when cycling after a shot has been fired.

"Firearm" is used herein to refer to all weapons to which an extractor can be attached, such as bolt action, lever-action, semi-automatic and fully automatic weapons. A preferred weapon for attaching the present invention is the bull pup rifle.

The directional terms "horizontal," "vertical," "front," "forward," "rear," "rearward," "right," "left" refer to the firearm when held in the normal firing position.

Listed below are the components of the dual pivoting extractor assembly shown in FIGS. 1-14.

10 Bolt carrier of cartridge case extractor
11 Right front cam surface
12 Left front cam surface
15 Ejector impact surface
17 Transverse retaining pin
20 Bolt carrier extension for cartridge case extractor
21 Rear housing guide for bolt carrier extension
23 Right recoil spring rod attached to inside right side of bolt carrier extension
24 Left recoil spring rod attached to inside left side of bolt carrier extension
25 Tension screws holding springs onto rods
26 Anchor plate for right and left recoil spring rods
27 Openings for screws to secure bolt carrier of cartridge case extractor to bolt carrier extension
**27*a*** Matching threaded screw holes in bolt carrier of cartridge case extractor
30 Curved ejection chute
40 Handle for manual recoil of bolt carrier extension
45 Forward housing for ejection chute with bore hole
50 Bore hole in forward housing through which spent case is ejected
60 Barrel of firearm
70 Magazine for cartridges to be fed into barrel chamber
80 Firearm to which the cartridge case extractor assembly is attached
110 Breech block of cartridge case extractor
112 Left pivoting extractor arm
114 Right pivoting extractor arm
116 Spring clip
118 Assisting coil spring
120 Transverse longitudinal L-shaped slot
122 Right wedge-shaped guide or notch
124 Left wedge-shaped guide or notch
126 Axis for pivoting
200 Receiver with inner curved surface
400 Cartridge to be fired
500 Spent cartridge case
a Lower catch area of gripping end for right pivoting arm
b Upper catch of gripping end for right pivoting arm
c Lower catch of gripping end for left pivoting arm
d Upper catch area of gripping end for left pivoting arm
e Right orifice for insertion of spring clip
f Left orifice for insertion of spring clip
g Orifice in breech block of cartridge case extractor for insertion of the pivoting axis In general, the operation of the cartridge case ejector of the present invention includes the use of a pivoting extractor, preferably, dual pivoting extractors with gripping ends that hold the rear end of the cartridge case while the ejection device moves rearward on a slideable breech block carriage, propelled backward by applying force to a spring-loaded assembly bolt carrier extension.

The extraction/ejection cycle described below is applicable to a cartridge or spent cartridge case; however, the description is as if the weapon has been fired and a spent cartridge case is left in the barrel chamber.

In an extraction/ejection cycle, single or dual pivoting extractor grabs the rear rim of a cartridge before the firearm is fired; the extractor holds on to the spent case left in the chamber; the extractor moves the spent case backwards on a horizontal plane relative to the rifle barrel while pivoting to lift or cam up the spent cartridge case at an angle; the magazine exposes a new cartridge; the pivoting extractor moves forward on the sliding breech block; the pivoting extractor cams down and exposes the spent cartridge case into a chute or exit portal on top of the rifle; simultaneously, the front end of the breech block pushes a new cartridge into the barrel of the firearm and the bolt carrier pushes the spent cartridge case into an exit portal on the firearm. The preferred exit portal is a curved chute on top of the rifle.

The cycle of gripping, rearward movement, raising or pivoting, moving forward and releasing a cartridge or spent cartridge case into an ejection chute takes about 1/10 of a second and is automatic, continuous and safe for any user of the cartridge case ejection device of the present invention.

The cartridge case extractor assembly of the present invention consists of four distinct, carefully machined, and easy to manufacture parts, which are, the bolt carrier of the extractor, the breech block of the extractor, the spring-loaded bolt carrier extension, and the extractor chute.

FIG. 1 is a perspective view of the cartridge case ejection device and the ejection chute on top of the firearm. The bolt carrier 10 of the cartridge extractor is positioned above the magazine 70 and aligned with the ejection chute 30 that curves slightly to the right side of the top of the firearm 80, below and to the right of handle 40 used for manual recoil of the bolt carrier. The ejection chute 30 terminates in a forward housing 45 with an opening 50 through which the cartridge or spent cartridge case exits to the side of the barrel 60. The forward housing 45 provides a secure means for attaching the end of the chute 30 to the top of the firearm 80. The chute 30 is made of a strong, thin gauge metal and is approximately 12 inches in length, and approximately 0.5 inches in diameter.

The chute 30 can be adapted to curve slightly to the left or right to accommodate the preferences of a right- or left-handed shooter.

FIG. 1 also shows a rear housing 21 which guides the bolt carrier extension backward and forward stabilizing the movement of the cartridge case ejection apparatus disclosed herein. The rear housing 21 and the forward housing 45 have threaded screw holes for attachment of optical sights.

Figure 2:
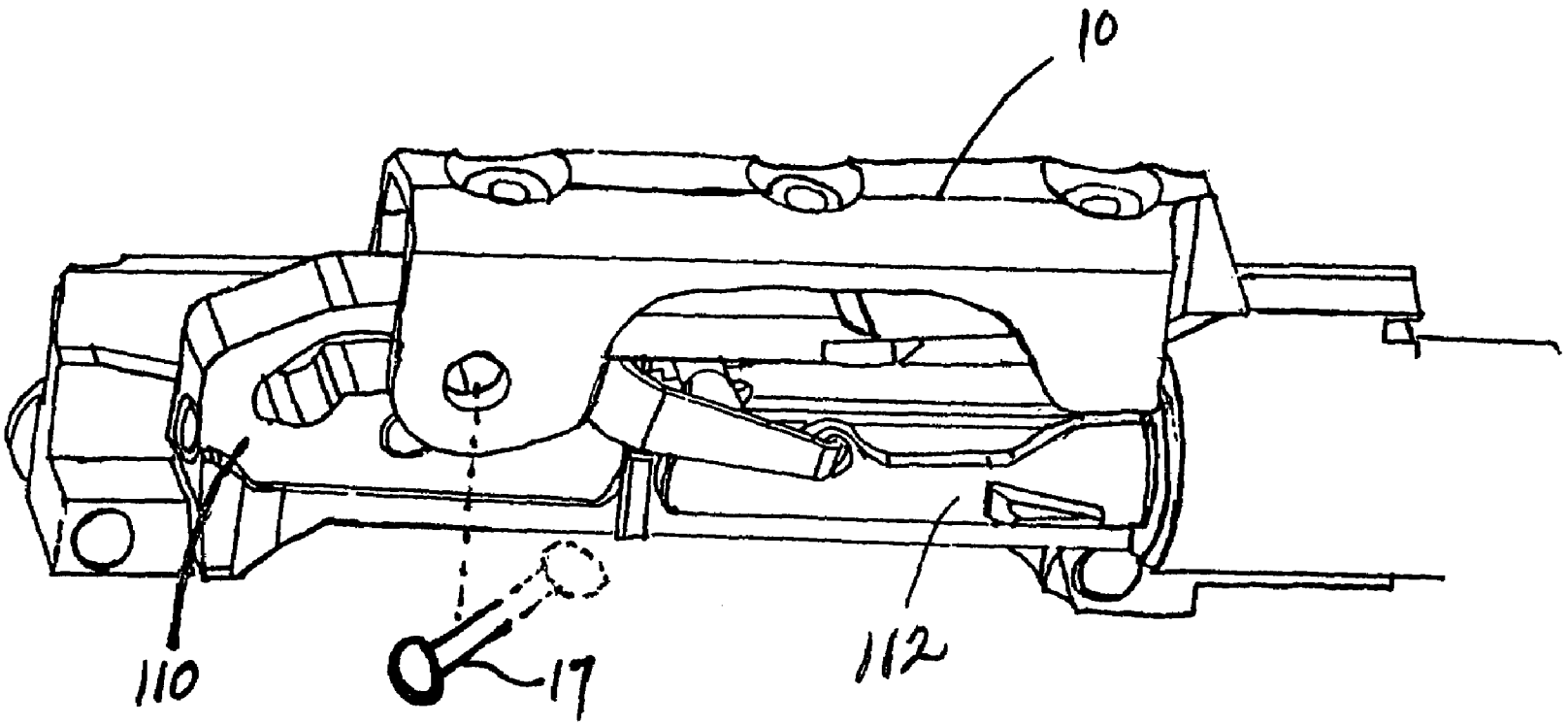
FIG. 2 is an enlarged side view of the cartridge case extractor with bolt carrier extension removed.

FIG. 2 is an enlarged side view of the cartridge case extractor showing how the bolt carrier 10 is seated on the breech block 110. A retaining pin 17 connects the bolt carrier 10 to the breech block 110 and provides a transverse axis that cooperates in the forward, backward and pivoting movements of pivoting arms 112 and 114 (not shown).

Figure 3:
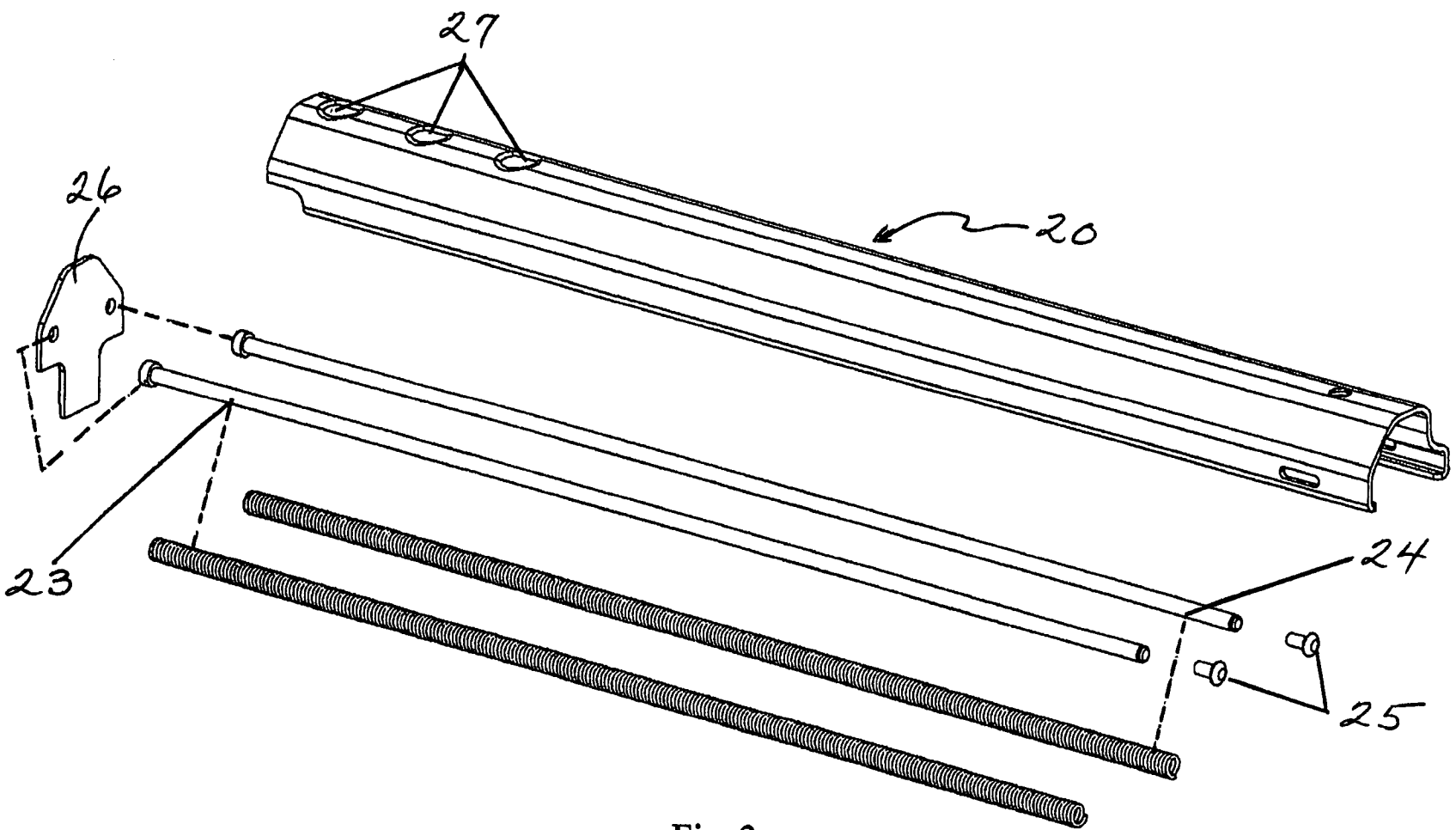
FIG. 3 is an exploded plan perspective view of the bolt carrier extension for the cartridge case extractor.

FIG. 3 is an exploded top perspective view of the cartridge case extractor bolt carrier extension 20, which is approximately 14 inches in length and approximately 1.25 inches in diameter with three screw holes 27 at the distal end spaced approximately 1 inch apart. The screw holes 27 align matingly with three threaded openings in the bolt carrier 10 of the extractor, so that the bolt carrier extension 20 and the bolt carrier 10 of the extractor are securely attached with screws for the operation of the extractor. The screw attachments shown in FIGS. 1-6 are an optional means of attaching the bolt carrier extension 20 to the bolt carrier 10; the extension and carrier can be welded together as shown in FIGS. 8-14. Any other means of metal to metal attachment can be used to provide a permanent and secure connection of the two parts.

Bolt carrier extension 20 may have an attached lever or handle 40 located at the forward end that is used to manually retract the bolt carrier extension to cause the backward movement of the extractor. It is also possible to install a gas piston in the forward housing 45 of the bolt carrier extension 20 that operates in conjunction with the firing of the weapon and generates a force sufficient to fully recoil the bolt carrier extension 20 with the attached cartridge case extractor. A set of spring rods 23 and 24 have springs held in place by screws 25 on one end with the opposite end permanently attached to an anchor plate 26 that hold the spring rods in parallel alignment. The spring rods 23 and 24 are mounted on a welded plate inside the cartridge extractor bolt carrier extension 20 at a distance that is approximately 8.5 inches from the distal end of bolt carrier extension 20. The spring rods 23 and 24 function as parallel spring-loaded rails that provide the force to move the extractor forward from the fully recoiled position.

Figure 4:
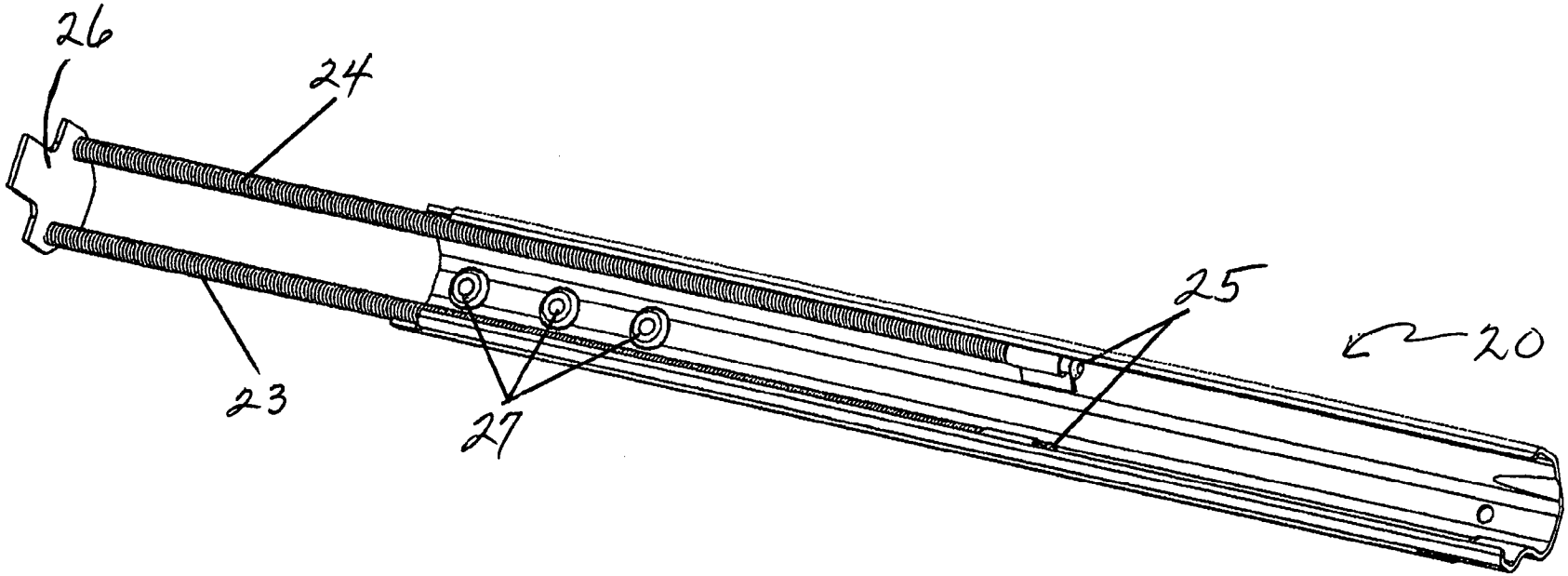
FIG. 4 is a bottom view of the bolt carrier extension assembly for the cartridge case extractor.

FIG. 4 is a bottom view of the assembled bolt carrier extension 20 showing screw holes 27 and the placement of the spring rods 23 and 24 with end screws 25 and attachment to anchor plate 26.

Figure 5:
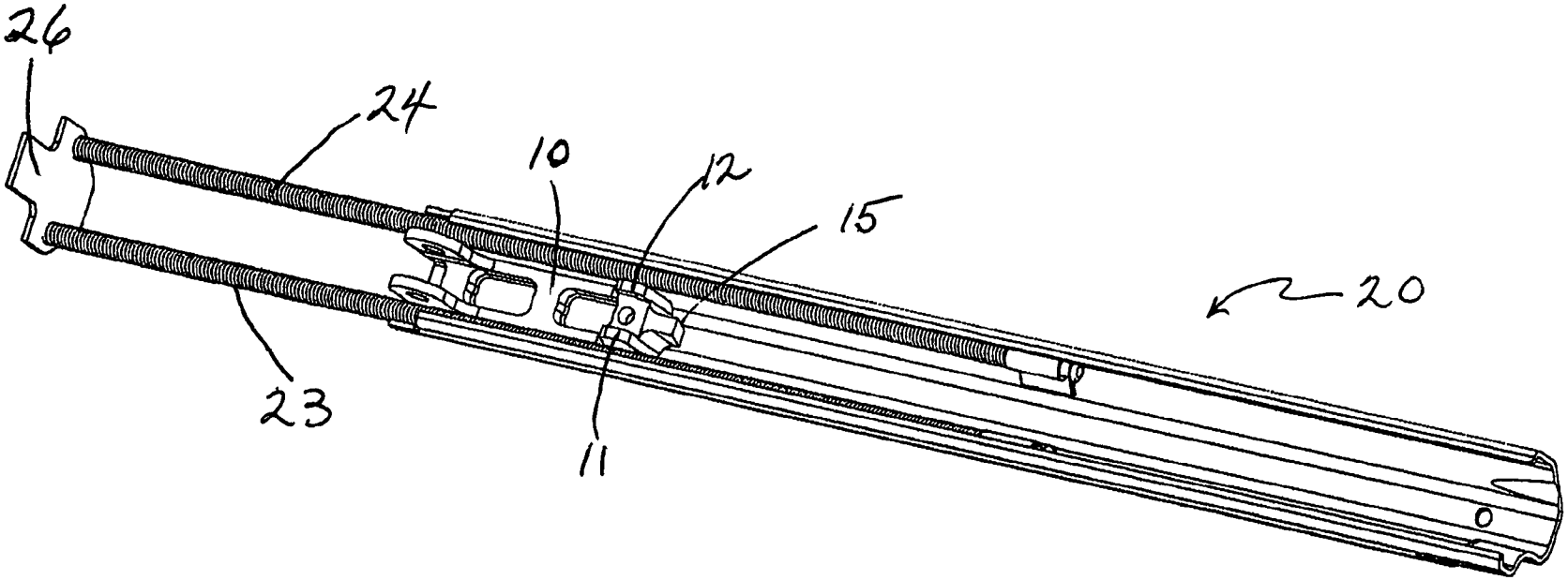
FIG. 5 is a bottom view of the bolt carrier extension assembly for the cartridge case extractor with the bolt carrier attached thereto.

FIG. 5 is a bottom view of the assembled bolt carrier extension 20 showing the placement of the bolt carrier 10 of the extractor with the right front cam surface 11 and left front cam surface 12 in place to slide forward and backward over spring rods 23 and 24 that are held in parallel alignment by anchor plate 26. Bolt carrier 10 is approximately 3.5 inches long, approximately 0.6 inches wide and approximately 1.25 inches high and is machined of one piece of steel. The bolt carrier 10 includes an ejector impact surface 15 that is designed to push the spent cartridge down the ejection chute or exit portal when the spent cartridge case is released by the dual pivoting extractor arms. The right front cam surface 11 and left front cam surface 12 cam down on the corresponding pivoting extractor arms and cause them to grip the rear end of a cartridge at the end of the extraction/ejection cycle.

Figure 6:
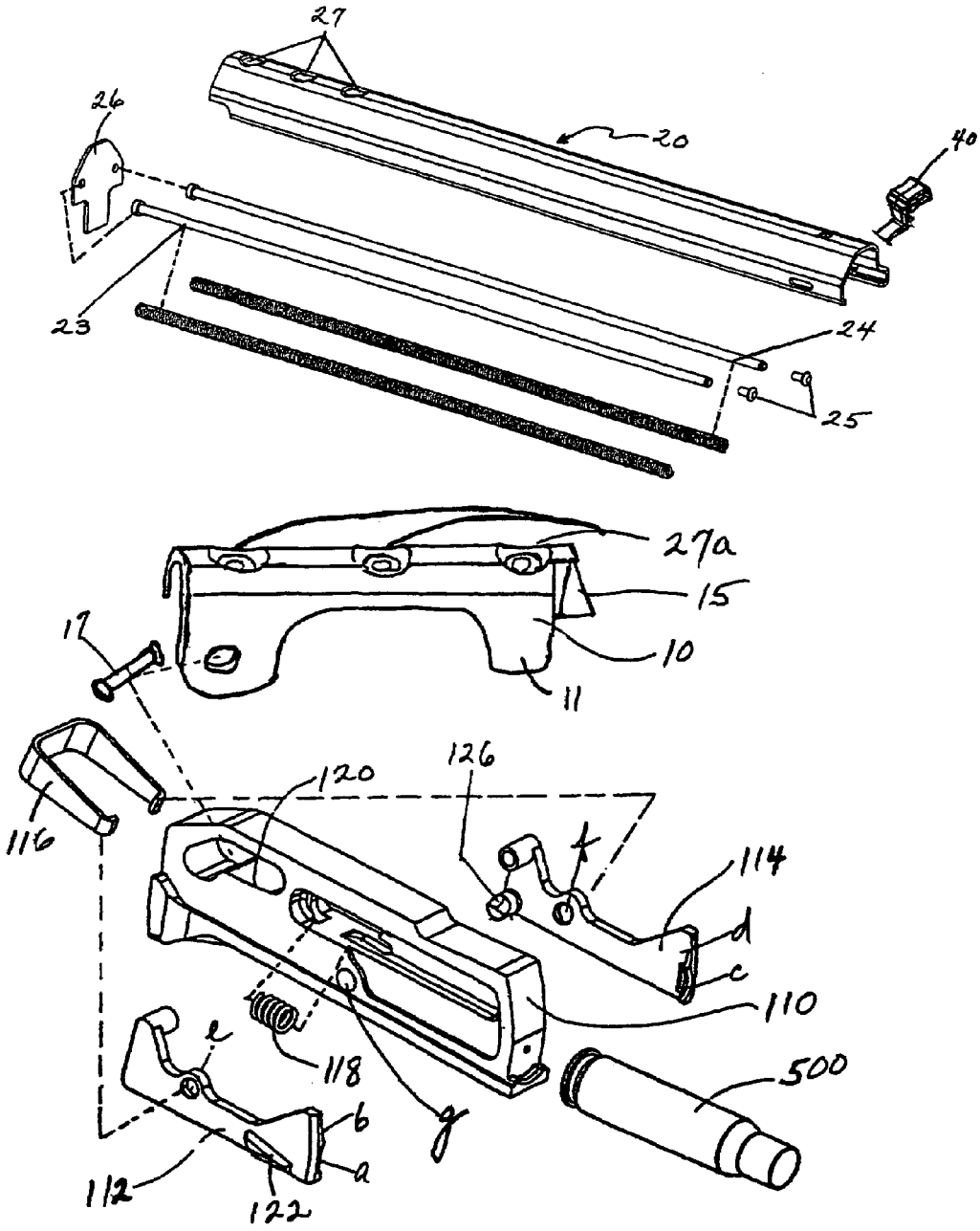
FIG. 6 is an exploded view of the cartridge case extractor of the present invention.

FIG. 6 is an exploded view of the cartridge case ejection device with all parts, including, but not limited to, dual pivoting extractor arms 112 and 114 each approximately 1.8 inches in length and each machined from one piece of steel to include a wedge-shaped guide or notch 122 (shown on right pivoting arm 112), gripping ends of arms 112 and 114 with lower catch areas a, c, and upper catch areas b and d. Orifices e and f are positioned approximately 0.75 inches from the rear of the pivoting arms to receive the connecting spring clip 116 for holding arms in pivoting position. Orifice g contains the pivoting axis 126.

Also shown in FIG. 6 is the assisting coil spring 118 that is centrally located in the body of the breech block 110 of the cartridge case extractor. Coil spring 118 assists with the cam motion of the dual pivoting extractor arms. Pivoting axis 126 protrudes from the left pivoting arm 114 to stabilize the dual pivoting extractor arms during pivoting, forward and rearward movement of the extractor assembly.

The bolt carrier 10 of the extractor assembly is attached to the breech block 110 with a transverse retaining pin 17 that extends through holes in the left and right rear end of the bolt carrier 10 and through a transverse longitudinal L-shaped slot 120 in the breech block 110. The L-shaped slot 120 is designed to assist in the action of raising and lowering the pivoting arms. Bolt carrier 10 further includes right front cam surface 11 that functions together with left front cam surface 12 (shown in FIG. 5) to cam down the dual pivoting extractor arms at the end of the ejection of a cartridge or spent cartridge case.

Also shown in FIG. 6 is the extractor bolt carrier extension 20 with handle or lever 40 for manual recoil of the entire extractor assembly when the bolt carrier 10 is connected by the transverse retaining pin 17 to the breech block 110 and the bolt carrier extension 20 is secured by the appropriate screws with holes 27 aligned with threaded screw holes **27*a* in the bolt carrier 10**.

It should be noted that the design and fitting of each part of the extractor assembly is done with precision so that each groove, orifice, curved surface and angled piece is functional in gripping, pivoting, starting and stopping rearward and forward movement, including the frontal protrusion 15 on the bolt carrier 10 for pushing an empty case 500 down the ejection chute 30 or other acceptable exit portal on top of the firearm.

Another acceptable exit portal can include, but is not limited to, a deflector or guide at the point where forward movement of the extractor ceases, that allows the extracted case or cartridge to exit an opening in the extractor bolt carrier extension that is enclosed by an empty case collector for firearm as disclosed and claimed in U.S. Pat. No. 5,934,002 to Blanchet, the teachings of which are incorporated herein by reference.

Figure 7:
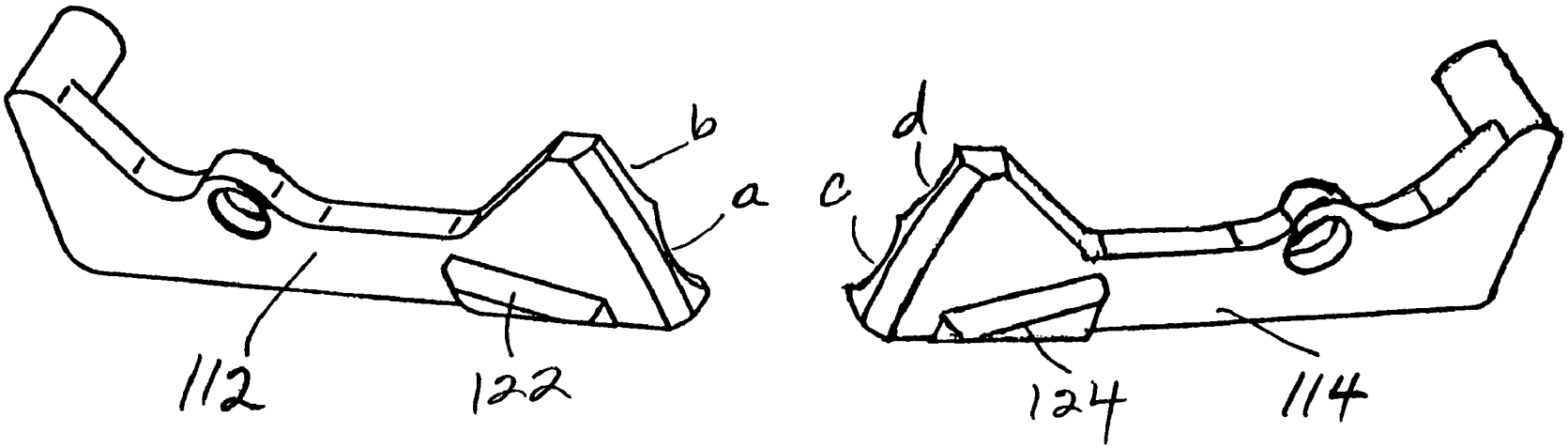
FIG. 7 is an enlarged view of the dual pivoting extractor arms of the cartridge case extractor.

FIG. 7 is an enlarged view of the dual pivoting extractor arms of the extractor assembly. Right arm 112 has a wedge-shaped guide or notch 122 that rides along an inner curved surface of the breech block attachment for the extractor assembly. The left arm 114 has a corresponding wedge-shaped guide or notch 124 that rides along an inner curved surface on the left side of the breech block attachment. The path taken in unison by wedge shaped guides 122 and 124 contribute to the raising and lowering of the dual pivoting extractor arms when moving backward and forward during the extraction and releasing of the spent cartridge case 500 in ejection chute 30. The function of the lower catch areas a and c and the upper catch area b and d will be explained in greater detail in the discussion of FIGS. 8-12.

Figure 8:
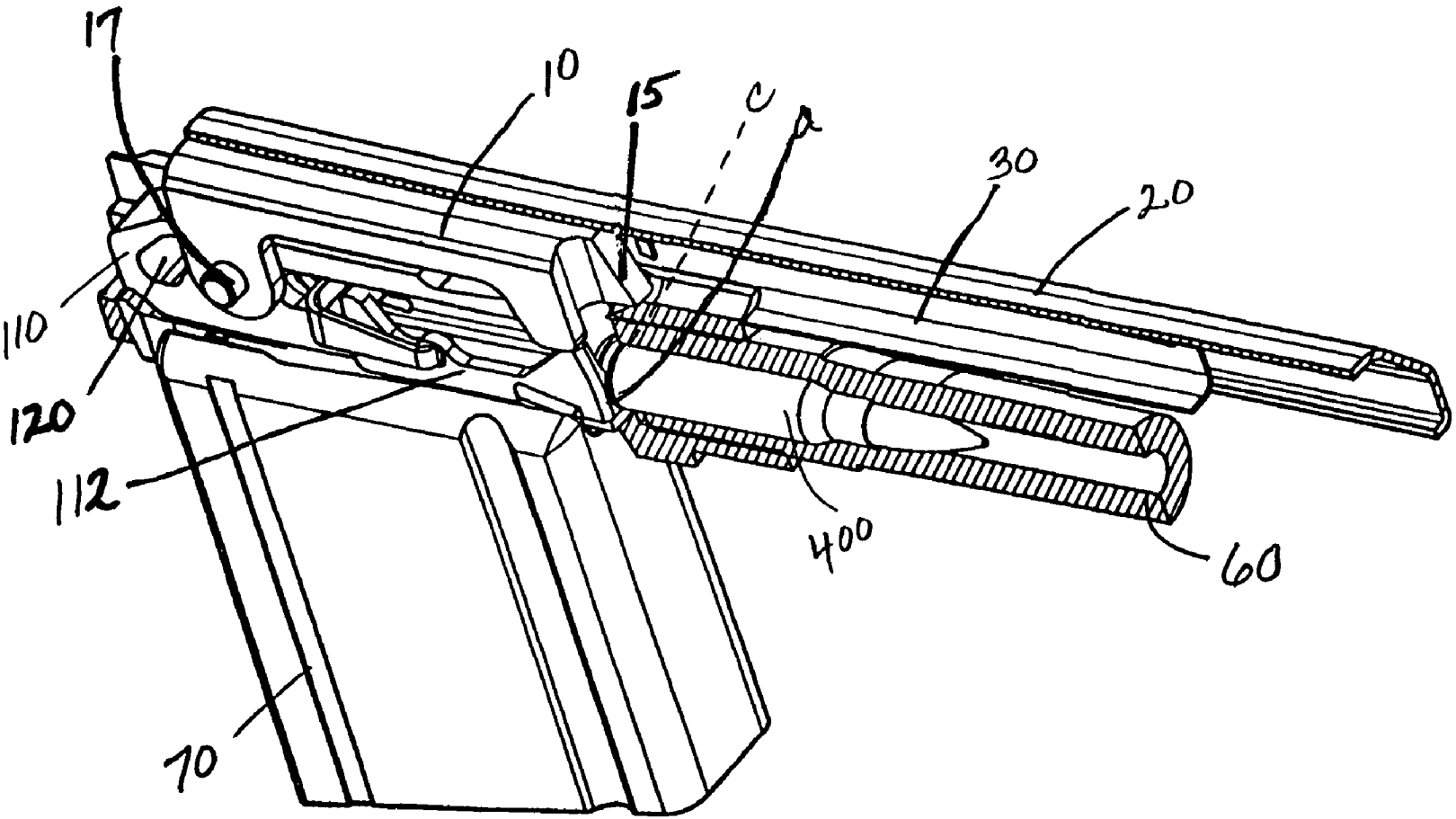
FIG. 8 is a partial cut-away perspective view of the cartridge case extractor showing the lower catch area of the dual pivoting extractor arms gripping the rear end of a cartridge in position to be fired.

FIG. 8 is a partial cut-away perspective view showing the position of the dual pivoting extractor assembly of the present invention positioned above a magazine 70 when a cartridge 400 has been moved from the magazine 70 and is chambered in the barrel 60 of a firearm. The bolt carrier 10 is connected to the breech block 110 by the transverse retaining pin 17 inserted through the transverse longitudinal L-shaped slot 120 of breech block 110. This position is considered the beginning of the extraction/ejection cycle of the extractor assembly. Pivoting arm 112 is gripping the rear end of the cartridge 400 in the lower catch area a. Ejector impact surface 15 is aligned with the ejection chute 30 and bolt carrier extension 20 is shown in an attached position.

Figure 9:
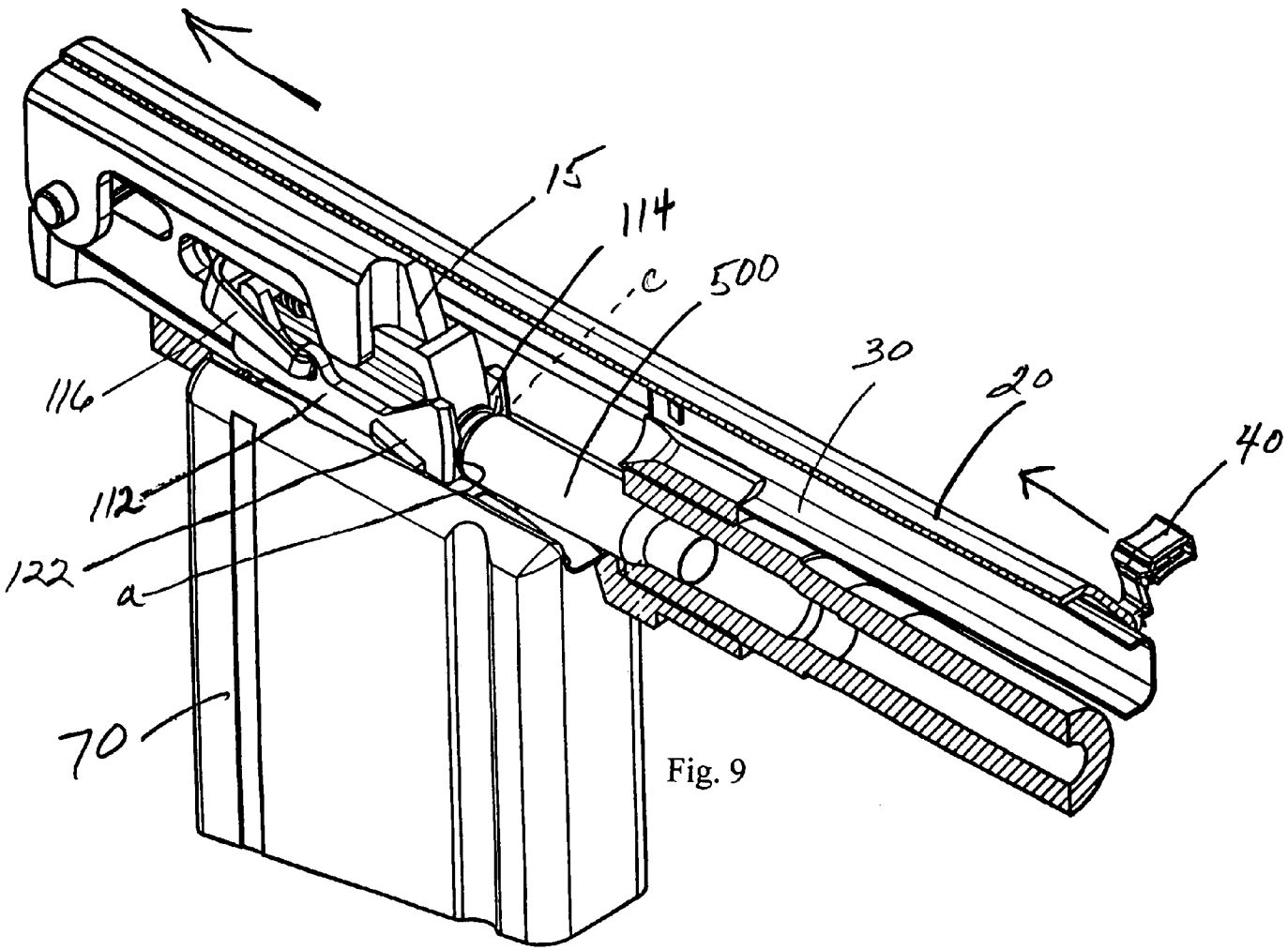
FIG. 9 is a partial cut-away perspective view of the cartridge case extractor after the firearm is fired, showing the lower catch area of the dual pivoting extractor arms gripping the rear end of a cartridge and extracting the spent case from the barrel of the gun as the entire extractor assembly moves rearward.

FIG. 9 is a partial cut-away perspective view showing the position of the dual pivoting extractor assembly of the present invention as it begins to move rearward away from magazine 70 after the firing of cartridge 400 (FIG. 8). The rearward movement is caused by the manual force using lever 40 or a gas piston (not shown). Pivoting arms 112 and 114 are shown gripping the rear end of the spent cartridge 500 in the lower catch area a and c and extracting the cartridge from the barrel of the firearm. Ejector impact surface 15 is also moving rearward away from the ejection chute 30 and bolt carrier extension 20 is shown in an attached position.

Figure 10:
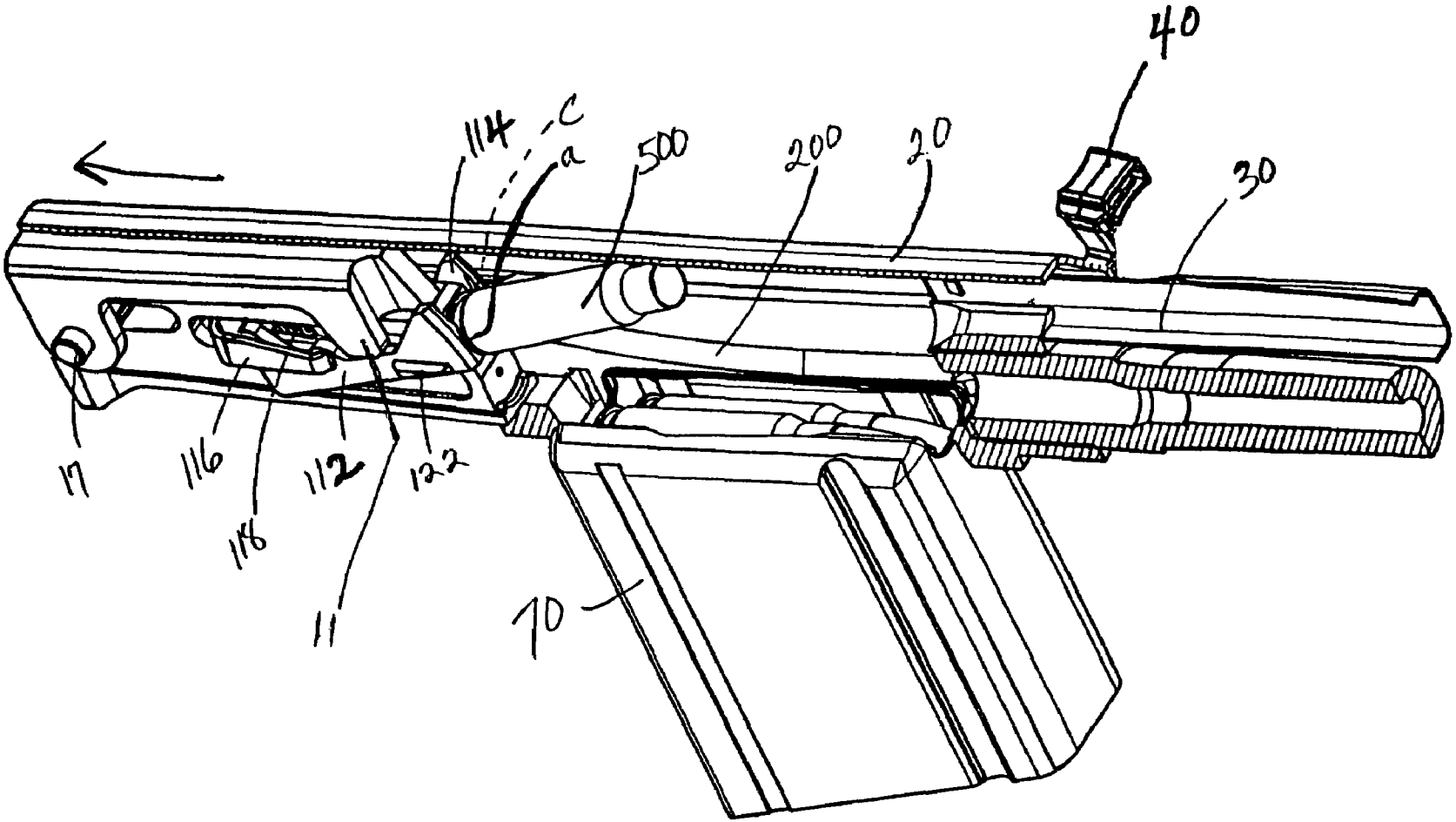
FIG. 10 is a partial cut-away perspective view of the cartridge case extractor showing the lower catch area of the dual pivoting extractor arms gripping the rear end of a cartridge at the end of the rearward movement of the extractor assembly with the empty case raised at an acute angle.

FIG. 10 is a partial cut-away perspective view showing the position of the dual pivoting extractor assembly of the present invention at the end of its rearward movement away and to the rear of magazine 70. At this point, the magazine 70 is now cleared to release a new cartridge 400 for the barrel of the firearm. At this position, pivoting extractor arms 112 and 114 are still gripping the rear end of the spent cartridge 500 in the lower catch area a and c, after extracting the cartridge from the barrel of the firearm and is pivoting the spent cartridge case 500 at an acute angle as a result of the guide 122 traveling along the inner curved surface 200 of the receiver attachment, the extractor arms are cammed up as the transverse retaining pin 17 drops into the lowest portion of the transverse longitudinal L-shaped slot 120 and the spring clip 116 holds the pivoting arms upward.

Limits on the upward movement of the case 500 are provided by the extractor bolt carrier extension 20, the right front cam surface 11 and the left front cam surface 12 (not shown). The extractor assembly is at the most rearward position from the ejection chute 30. Note the ejection chute bolt carrier extension 20 in its attached position.

Figure 11:
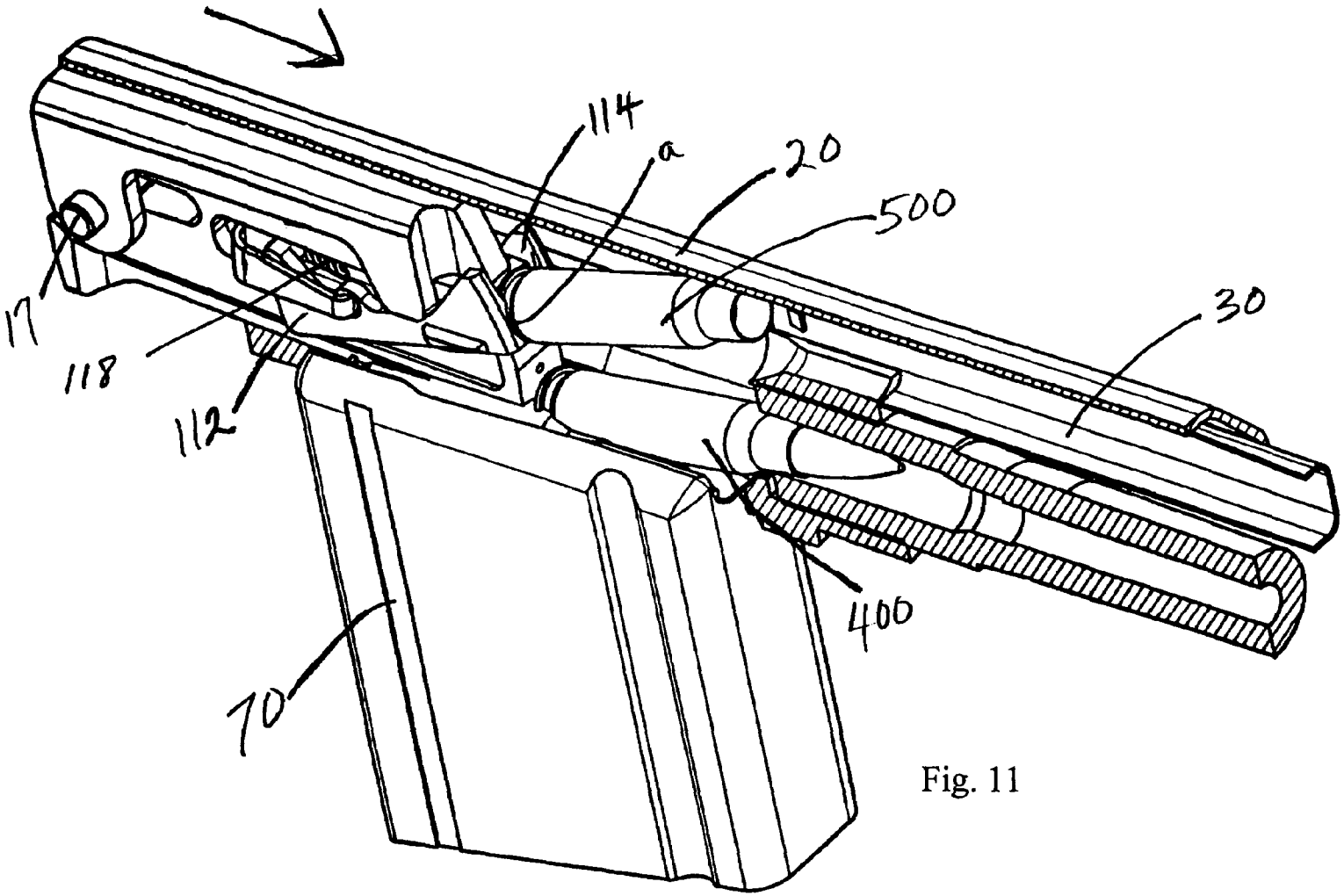
FIG. 11 is a partial cut-away perspective view of the cartridge case extractor showing the lower catch area of the dual pivoting extractor arms gripping and holding the rear end of a spent case in a raised and angled position in line with the ejection chute, as the extractor assembly moves forward and the breech block feeds the new cartridge into the barrel.

FIG. 11 is a partial cut-away perspective view showing the position of the dual pivoting extractor assembly of the present invention as it begins forward movement toward and above magazine 70. At this point, the magazine 70 is exposing a new cartridge 400 and the breech block 110 feeds the new cartridge into the barrel of the firearm. At this position, pivoting arms 112 and 114 are still gripping the rear end of the spent cartridge 500 in the lower catch area a and c, and the spent cartridge case 500 is held at an acute angle and stabilized by the action of the assisting coil spring 118 (shown in FIG. 6). The transverse retaining pin 17 remains in the lowest portion of the transverse longitudinal L-shaped slot 120 as the spent cartridge 500 remains in the pivoted position with the front end moving laterally along the inside of the extractor bolt carrier extension 20 in line with the ejection chute 30. Note the position of the ejection chute bolt carrier extension 20 does not change in relation to the bolt carrier 10 of the extractor assembly because of secure attachment or connection by screws, welding, or other techniques known to those skilled in the art.

Figure 12:
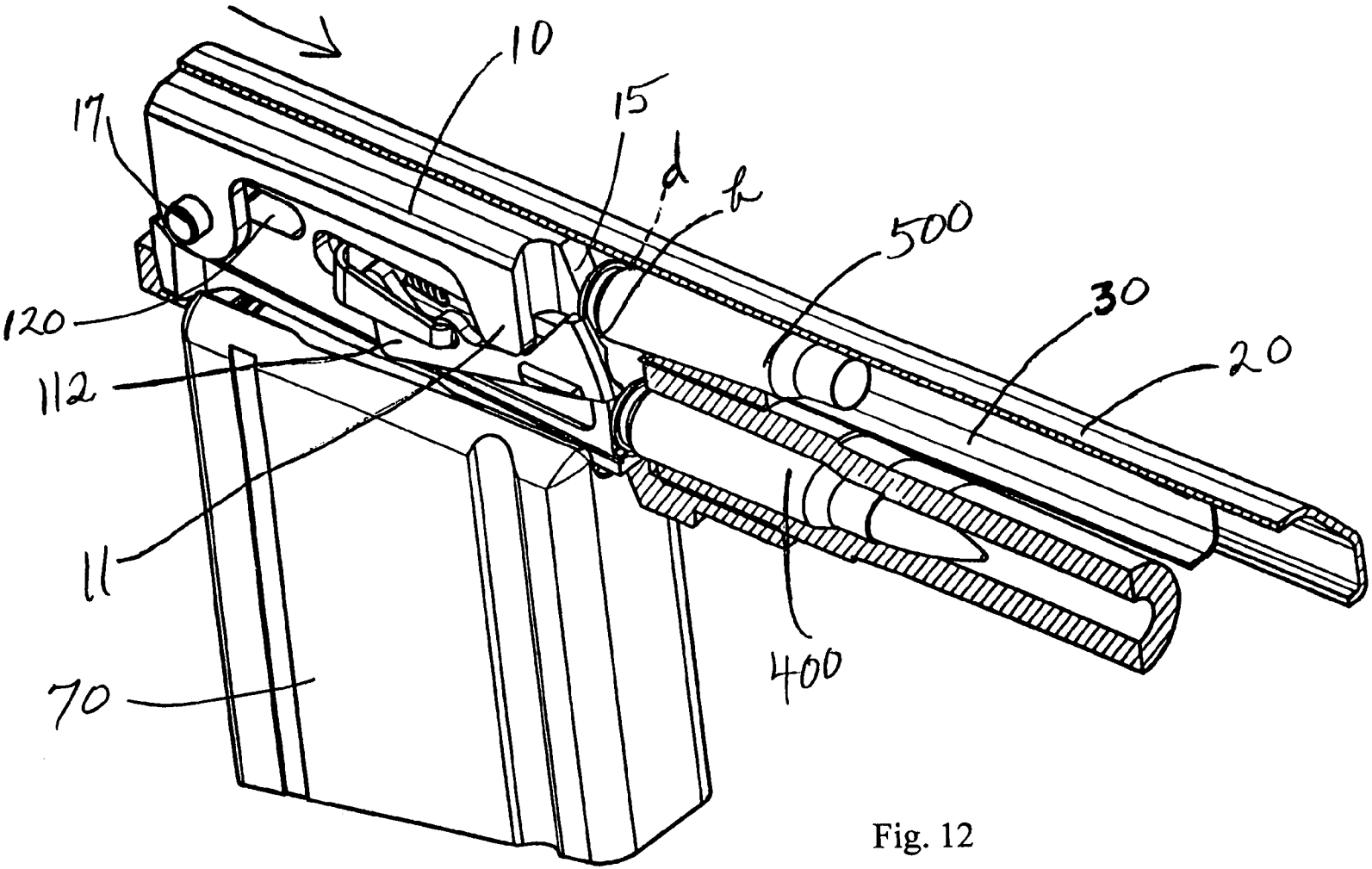
FIG. 12 is a partial cut-away perspective view of the cartridge case extractor showing the rear end of a spent cartridge moving from the lower catch area of the dual pivoting extractor arms to the upper catch area as the cartridge enters the space between the extractor bolt carrier extension and the ejection chute while simultaneously loading the cartridge.

FIG. 12 is a partial cut-away perspective view showing the position of the dual pivoting extractor assembly of the present invention just before the end of its forward movement toward and above magazine 70. At this point, the breech block 110 has fed a new cartridge 400 into the barrel of the firearm. At this position, the spent cartridge 500 is in contact with receiving end of the ejection chute 30 and the pivoting arms 112 and 114 are releasing the rear end of the spent cartridge 500 into the upper catch area b and d, causing the spent cartridge case 500 to move into a horizontal position between the extractor bolt carrier extension 20 and the ejection chute 30. The transverse retaining pin 17 is still in the lowest portion of the transverse longitudinal L-shaped slot 120 providing tension and stability so that the spent cartridge 500 moves into the upper catch area area b and d. The force of the forward motion of the spring-loaded bolt carrier extension and extractor assembly moves the spent cartridge 500 into a horizontal position with the front end moving laterally along the inside of the extractor bolt carrier extension 20 into the ejection chute 30. The position of the bolt carrier extension 20 does not change in relation to the bolt carrier 10 of the extractor assembly.

Figure 13:
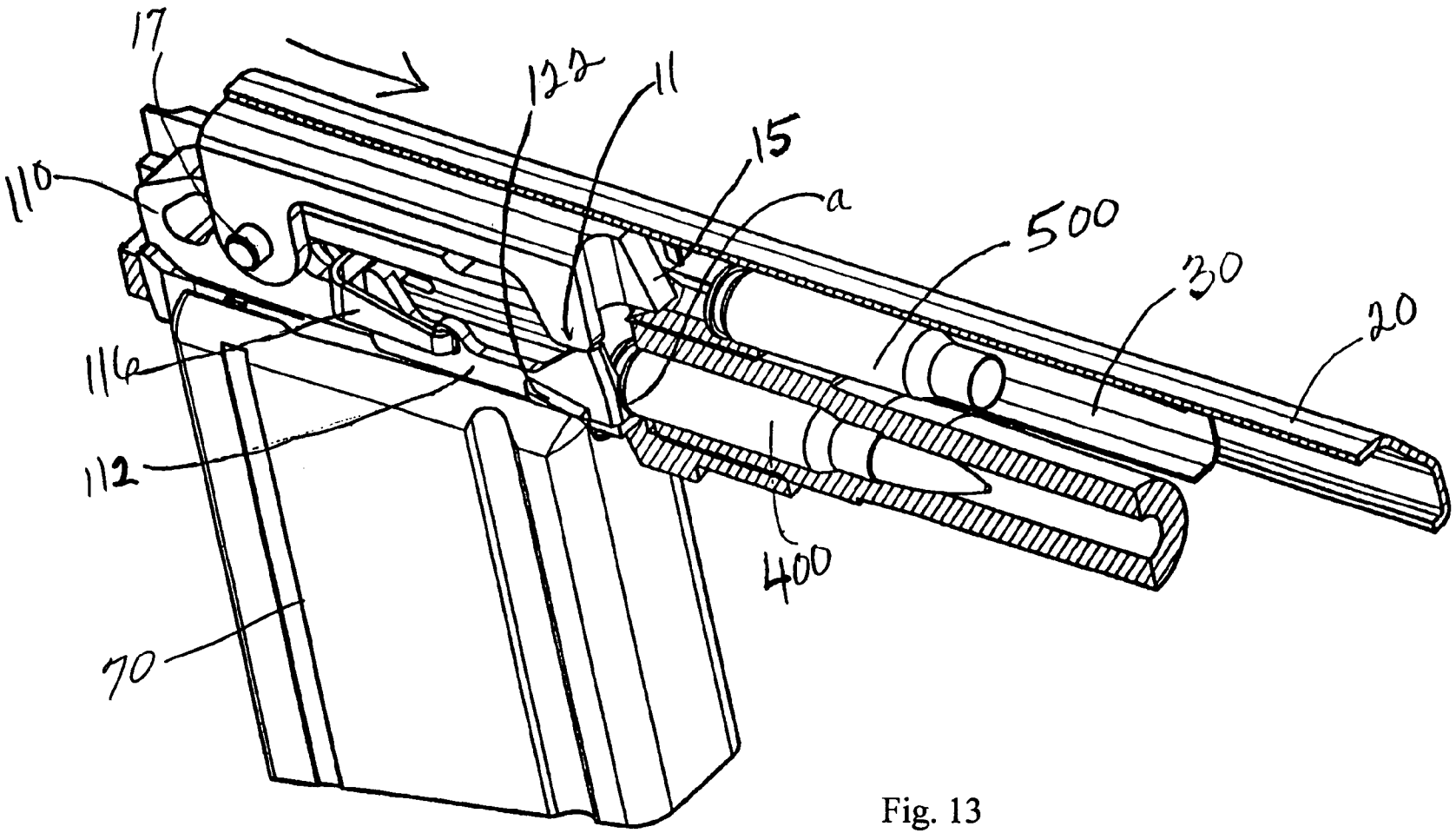
FIG. 13 is a partial cut-away perspective view of the cartridge case extractor showing the empty cartridge case being pushed down the ejection chute as the dual pivoting extractor arms are cammed down to grasp the rear end of a new cartridge case with bullet that has moved from the magazine into the barrel of the firearm.

FIG. 13 is a partial cut-away perspective view showing the position of the dual pivoting extractor assembly of the present invention at the end of its forward movement above magazine 70. At this point, a new cartridge 400 is chambered in the barrel of the firearm. At this position, the spent cartridge 500 is released from the upper catch area area b and d of the dual pivoting extractor arms into ejection chute 30 and the pivoting arms 112 and 114 are cammed down by right front cam surface 11 and the left front cam surface 12 (not shown). The transverse retaining pin 17 now moves laterally along the transverse longitudinal L-shaped slot 120 causing the ejector impact surface 15 to push the spent cartridge case 500 down the ejection chute 30. The force of dropping the dual pivoting extractor arms after the release of the spent cartridge case 500 causes the right pivoting arm 112 to grip about the rear end of the new cartridge 400 in the lower catch area a. It is understood that the left pivoting arm 114 having lower catch area c works in unison with the right pivoting arm 112. To reiterate, the position of bolt carrier extension 20 does not change in relation to the bolt carrier 10 of the extractor assembly because the two parts are securely attached.

Figure 14:
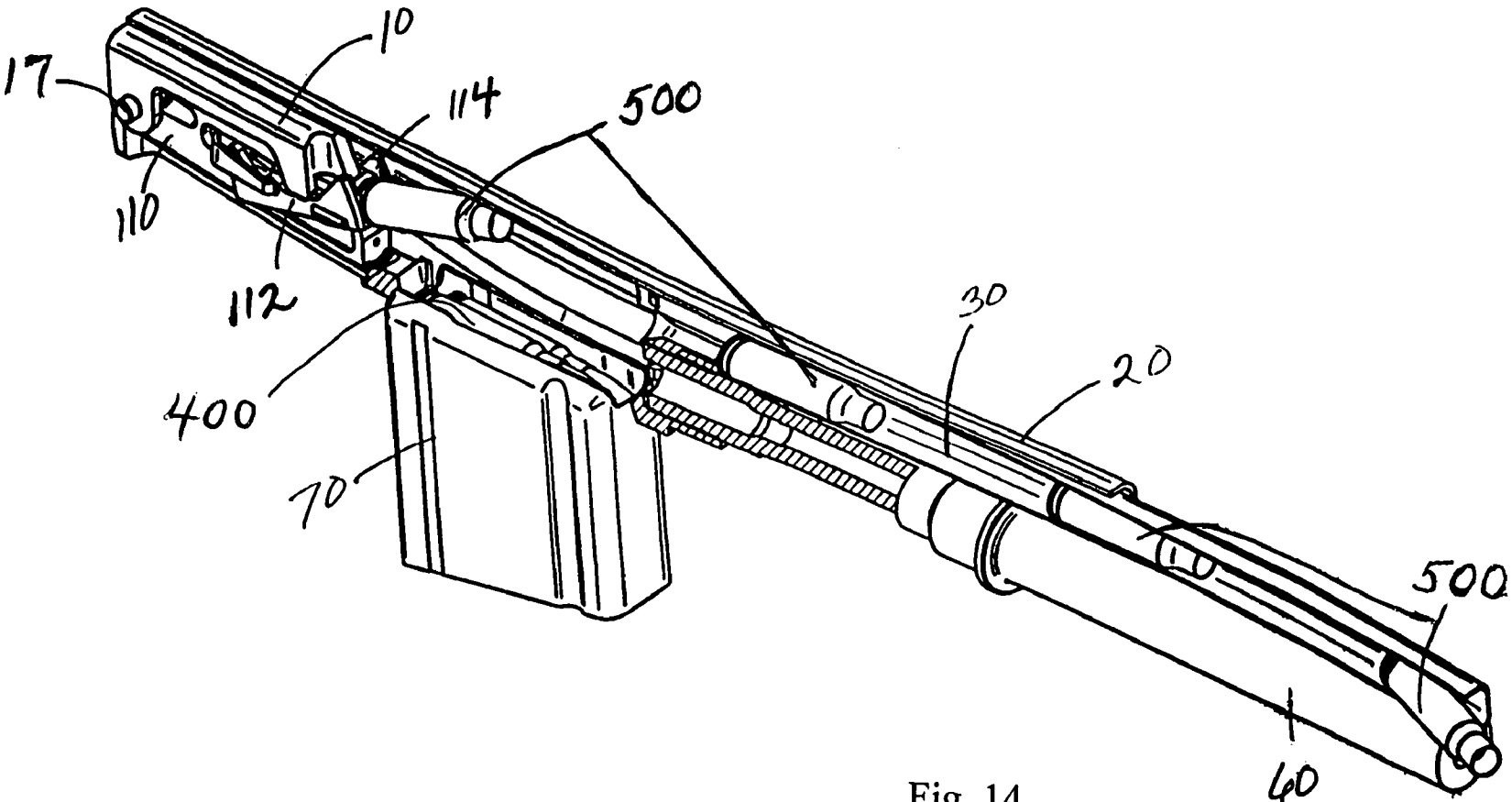
FIG. 14 is a partial cut-away perspective view of the cartridge case extractor showing empty cartridge cases exiting the ejection cute to side of firearm.

FIG. 14 is a partial cut-away perspective view showing the position of the dual pivoting extractor assembly of the present invention at the end of its rearward movement away from magazine 70. At this point, the magazine 70 is now exposing a new cartridge 400 that will be fed into the barrel of the firearm by breech block 110. At this position, pivoting arms 112 and 114 are gripping the rear end of a spent cartridge 500; however, this operation is shown after several complete cycles of extraction and ejection of cartridge cases as shown by the three spent cartridges in the ejection chute 30. The bolt carrier 10 connected to the breech block 110 by a transverse retaining pin 17 have been moved to the position shown by the spring-loaded extractor bolt carrier extension 20. Spent cartridge cases 500 are shown exiting the ejection chute 30 above the barrel 60 to the right of the firearm.

FIG. 15 is a flow chart of the extraction/ejection cycle of the cartridge case extractor assembly of the present invention. The cycle begins with the extractor assembly in its forward most position with the dual pivoting extractor arms gripping the rear end of a cartridge chambered in the barrel of a firearm. The weapon fires, or the shooter may decide to extract the cartridge rather than fire it, in either case, the operation is the same and is explained herein as if the shooter has fired the weapon.

After firing the weapon, an empty cartridge case is left in the barrel of the firearm. Force one can be a manual pull on a lever attached to the extractor bolt carrier extension or the action of a gas piston installed in the forward housing 45 that will impact the forward end of the bolt carrier extension. This force moves the extractor assembly rearward while the dual pivoting extractor pulls the empty case out of the chamber.

The dual extractor on the slideable breech block moves rearward over the curved inner surface of the receiver and raises or cams up the empty case at an acute angle in alignment with an ejection chute positioned on top of the barrel of the firearm. In this rearward position, a new cartridge is exposed in the magazine.

Force two that moves the assembly towards the chute is the spring-loaded arrangement in the extractor bolt carrier extension. The slideable breech block moves forward, contacts the rear of a new cartridge and pushes the cartridge toward the barrel while the dual extractors hold the empty cartridge case in a pivoted position. The empty cartridge case comes in contact with the entrance to the ejection chute and the force of the contact (Force three) moves the case from the lower catch area of the pivoting extractor to the upper catch area of the pivoting extractor. Then, the space between the extractor bolt carrier extension and the entrance to the ejection chute forces the cartridge to move laterally in a horizontal position.

At the end of the forward movement of the extractor assembly, the breech block chambers a new cartridge into the barrel of the firearm and the dual pivoting extractor releases the cartridge case into the ejection chute before it cams down to grip the rear end of a new cartridge. As the pivoting extractor arms cam down, force four, the ejector impact surface, pushes the cartridge case, so that the case safely exits the ejection chute that is curved to the side of the firearm. This is the end of the cycle, which is completed in less than approximately 0.1 of a second.

Disclosed herein is a device designed to improve the functioning of a firearm, such as, a bull pup rifle, with a forward cartridge or spent cartridge-case ejecting system by providing a simpler, more condensed mechanism. Four distinct, carefully machined parts function to safely and reliably extract and eject cartridges or empty cartridge cases in a manner that does not injure or interfere with the shooter's line of sight.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An apparatus for extracting and ejecting cartridges or spent cartridge cases from firearms, comprising in combination:

a rifle having a trigger and a magazine holding ammunition;

an extractor with a pair of pivoting arms that work in unison, including a left pivoting extractor arm and a right pivoting extractor arm, each with a lower catch area and an upper catch area at a gripping end that grips a rear end of a cartridge case in the lower catch area when the pair of pivoting arms is moving in a rearward position, the pair of pivoting extractor arms raising and lowering a spent cartridge case relative to the rifle; and an ejector which includes the upper catch area of the pair of pivoting arms that releases the spent cartridge case as the pair of pivoting arms cams down from a pivoted position ejecting the spent cartridge case into an exit portal on the firearm.

2. The apparatus of claim 1, wherein the exit portal includes a chute on the rifle, the chute for allowing the spent cartridge case to eject forward and to one side of the rifle.

3. The apparatus of claim 1, wherein the exit portal includes an attached flexible, fireproof container to receive and collect the spent cartridge case ejected forward and to one side of the rifle.

4. The apparatus of claim 1, wherein the extractor further includes a slideable carriage for supporting the pair of pivoting arms, wherein the slideable carriage moves the grabbed spent cartridge case in a horizontal direction relative to the rifle.

5. The apparatus of claim 1, wherein the pair of pivoting extractor arms cam up the spent cartridge case to an acute angle in line with the exit portal on the firearm.

6. The apparatus of claim 1, wherein the pair of pivoting extractor arms release the spent cartridge case into an ejection chute and cam down to grip about the rear end of a new cartridge.

7. The apparatus of claim 1 that further includes a spring-loaded bolt carrier extension.

8. The apparatus of claim 7, wherein the spring-loaded bolt carrier extension is activated manually by a handle.

9. The apparatus of claim 7, wherein the spring-loaded bolt carrier extension is activated automatically by a gas piston.

10. A method for extracting and ejecting a cartridge or a spent cartridge case from a firearm including the steps of:

providing a rifle having a trigger and a magazine holding ammunition;

attaching an extractor with a pair of pivoting extractor arms that work in unison, including a left pivoting extractor arm and a right pivoting extractor arm, each with a lower catch area and an upper catch area at a gripping end that grips a rear end of a cartridge case in the lower catch area when the pair of pivoting arms is moving in a rearward position, the pair of pivoting extractor arms raising and lowering a spent cartridge case relative to the rifle to a pivoted position where the spent cartridge case contacts an entrance to an ejection chute moving the spent case from the lower catch area to the upper catch area of the pair of pivoting extractor arms;

releasing the spent cartridge case from the upper catch area of the pair of pivoting extractor arms as the pair of pivoting extractor arms cams down from the pivoted position into an exit portal on the firearm; and ejecting the released spent cartridge case into the exit portal thereby safely removing the spent cartridge case on the side of the firearm and out of the sight line.

11. The method of claim 10, wherein the exit portal includes a chute on the rifle, the chute for allowing the spent cartridge case to eject forward and to one side of the rifle.

12. The method of claim 10, wherein the exit portal includes an attached flexible, fireproof container to receive and collect the spent cartridge case ejected forward and to one side of the rifle.

13. The method of claim 10, wherein the extractor further includes a slideable carriage for supporting the pivoting arm, wherein the slideable carriage moves the grabbed spent cartridge case in a horizontal direction relative to the rifle.

14. The method of claim 10, wherein the pair of pivoting extractor arms cam up the spent cartridge case to an acute angle in line with the exit portal on the firearm.

15. The method of claim 10, wherein the pair of pivoting extractor arms release the spent cartridge case into an ejection chute and cam down to grip about the rear end of a new cartridge.

16. The method of claim 10 that further includes a spring-loaded bolt carrier extension.

17. The method of claim 16, further comprising the step of manually activating the spring-loaded bolt carrier extension by a handle.

18. The method of claim 16, further comprising the step of automatically activating the spring-loaded bolt carrier extension by a gas piston.

* * * * *